United States Patent [19]

Buzano et al.

[11] Patent Number: 4,489,542

[45] Date of Patent: Dec. 25, 1984

[54] SPUN LIKE FIBER YARN PRODUCED BY INTERLACING

[75] Inventors: Michel Buzano, Villeurbanne; Joanny Danancier, Caluire, both of France

[73] Assignee: Rhone-Poulenc Fibres, Lyons, France

[21] Appl. No.: 452,720

[22] Filed: Dec. 23, 1982

[30] Foreign Application Priority Data

Dec. 28, 1981 [FR] France ..... 81 24469

[51] Int. Cl.[3] ..... D02G 3/34

[52] U.S. Cl. ..... 57/206; 57/208; 57/254; 57/328; 57/908

[58] Field of Search ..... 57/2, 206, 208, 254, 57/315, 328, 908; 28/140, 143, 144, 247, 252, 258, 271

[56] References Cited

U.S. PATENT DOCUMENTS

| | | | |
|---|---|---|---|
| 2,853,847 | 9/1958 | Keeler et al. | 57/328 |
| 3,992,865 | 11/1976 | Tuchida et al. | 57/328 |
| 4,070,815 | 1/1978 | Negishi et al. | 57/908 X |
| 4,244,171 | 1/1981 | Sasaki et al. | 57/208 |
| 4,384,448 | 5/1983 | Wilkie | 57/328 |
| 4,387,487 | 6/1983 | Nakahara et al. | 57/328 |

*Primary Examiner*—Donald Watkins

*Attorney, Agent, or Firm*—Sherman & Sherman

[57] ABSTRACT

Spun-like fiber yarn with interlaced threads, in which the fibers are of the same length. The spun yarn has alternating open, relatively bulky zones and closed, relatively compact zones. The open zones have a non-twisted structure with parallel strands. In the closed zones, the fibers are interlaced and non-bonded. The open zones furthermore have free strands. The cohesion factor of the spun fiber yarns is greater than 100 and preferably being between 120 and 180. The spun yarns are produced by a process in which at least one sliver of fibers of equal lengths is fed to a drawing unit and then to at least one open single-jet interlacing nozzle fed with gaseous fluid at a pressure of between 1 and 6 bars, the angle formed by the axis of the channel for the passage of the yarn in the nozzle and the yarn being between 10° and 80°, and the spun yarn obtained being wound up at a speed greater than 50 m/min. A device for carrying out the process includes at least one drawing unit, means to feed at least one sliver, tow or band of fibers to the drawing unit, at least one single jet fluid utilizing means of interlacing, means for regulating the tension of the spun yarn at the exit of the interlacing means and means for winding up the spun fiber yarn so obtained. The spun fibers can be used for all textile applications and provides good fabric coverage.

17 Claims, 6 Drawing Figures

SPUN LIKE FIBER YARN PRODUCED BY INTERLACING

The present application relates to a product of the spun fiber yarn type, obtained by interlacing of textile fibers, as well as to a process and an apparatus for its manufacture.

The manufacture of spun fiber yarns is well known in the textile industry. Thus spun yarns are obtained, in accordance with the conventional processes, by spinning slivers of staple fibers, drawn and twisted on continuous spinning frames. More recently, so-called "open-end" spinning, where the sliver of fibers feeds a turbine, and the product is produced by grading and twisting of the fibers has come into use. These processes may be employed for natural, artificial or synthetic fibers, used individually or as mixtures. The conventional process can be used for fibers of any length while the open-end spinning process is generally used for fibers which are generally of short length, of the order of at most 60 mm. Moreover, the speeds of production of spun fiber yarns are limited by the maximum speed which the mechanical means employed will withstand. For the conventional process the limiting speeds of spinning are of the order of 60 m/min for long fibers, while for the open-end process they are of the order of 60 m/min when using short fibers. It is, moreover, necessary to bear in mind the spinnability of the textile in question.

French Pat. No. 1,305,832 proposes producing compact interlaced yarns by means of a nozzle. In one example, a spun like fiber yarn is produced by interlacing. However, in this yarn the fibers are intensely interlaced; moreover, no information whatsoever concerning the conditions of production are given, and since the date of filing of the original application, in 1960, no product whatsoever of this type has appeared on the market, thereby suggesting difficulties in industrial implementation.

U.S. Pat. No. 3,079,746 has also proposed producing a bundled spun like fiber yarn by using a false-twist nozzle.

British Pat. No. 1,398,985 has proposed producing a spun like fiber yarn by interlacing a band of fibers at speeds which can be as high as 200 m/min in a special device in which the interlaced fibers are subjected to two jets of fluid, with overfeeding in the treatment zone; the interlaced yarn being produced meets a perforated plate. In these yarns the fibers can be of equal lengths.

It has also been proposed, In U.S. Pat. Nos. 4,080,778 and 4,118,921, to produce, by cracking/interlacing, a spun like fiber yarn of different length fibers having a well-defined distribution, by spinning at high wind-up speeds of the order of 200 m/min.

In U.S. Pat. No. 3,468,114 a method is described for making a spun like yarn by interlacing a running multifilament bundle by moving the bundle laterally into and out of contact with a lateral jet of fluid adapted to interlace the filaments, the frequency and duration of the contact of the bundle and the jet being selected to cause continuous interlacing of the yarn and the bundle being under a tension sufficient to prevent crunodal loops forming in the individual filaments. This process is intended to avoid irregular periodic structural change in which short lengths of densely interlaced filaments, i.e. "nodes," separate longer lengths of more open interlacing. Operating speeds of 500 meters per minute are disclosed.

For the production of spun like fiber yarns at high speeds by fiber interlacing it is accordingly known either to employ specific means if fibers of identical or different lengths are employed, or to use a cracking/interlacing process which makes it possible to have, in the final product obtained, a distribution of well-defined different lengths of fibers.

The present application proposes to produce a uniform spun like fiber yarn having properties compatible with those demanded in the textile industry, by employing simple means.

The present invention relates to a spun like fiber yarn produced from at least one group, e.g. sliver, band, tow, etc., of fibers with the fibers in each such group being of the same length; the yarn having alternating open zones and closed zones, of loosely packed and densely packed fibers, respectively, the fibers in the open zones being disposed substantially in parallel relationship and being non-twisted, the fibers in the intervening closed zones being interlaced and non-bonded, the open zones furthermore having free strands disposed transversely of the parallel fibers in the open zones, and the cohesion factor of the spun like fiber yarn being greater than 100, and preferably being between 120 and 180.

The present invention moreover relates to a process for the production of spun like fiber yarns as described above, in which at least one group of staple fibers of equal lengths is fed to a drawing unit and then passed through the channel of at least one open single-jet interlacing nozzle fed with gaseous fluid at a pressure which is preferably between 1 and 6 bars, the angle $\alpha$ formed by the axis of the channel for the passage of the yarn in the nozzle and the yarn being between 10° and 80°, preferably between 20° and 60°, and the yarn obtained being wound up at a speed greater than 50 m/min, preferably at speeds of from about 60 m/min to about 200 m/min.

The present invention furthermore relates to apparatus for carrying out the above process for the production of the spun like fiber yarn forming the subject of the present invention, the device including means for feeding at least one group, e.g. sliver of fibers, to at least one drawing unit, at least one open single-jet fluid-utilizing interlacing device, means for regulating the tension of the spun fiber yarn in the fluid interlacing zone and a means of winding up the spun fiber yarn.

It has in fact been found that by using open single-jet means of interlacing it is possible, starting from at least one band or sliver of fibers of equal lengths, to obtain a product whose textile properties are comparable with those of spun fiber yarns obtained in accordance with the conventional processes.

"Fibers of equal length" as used herein and in the appended claims is understood to include fibers of the same length as well as fibers having a maximum spread of plus or minus 10% relative to the mean length. The fibers may be smooth or crimped or may have a latent crimp, and these can be used individually or as blends of two or more of these. The length of crimped fibers is considered to be the length of the fiber in the uncrimped state. The fibers may be fabricated from natural, artificial or synthetic textile filaments or from blends of these. Where artificial or synthetic textiles are concerned, the fibers may be obtained by chopping or by passing through a converter for continuous bands of filaments, of all kinds. Where synthetic textiles are involved, they may be fabricated from a single polymer with the same characteristics or with different characteristics, or of several different polymers. When polymers having different characteristics or when different polymers are used, the fibers may be either in the form of a blend or mixture or in a side-by-side or core/sheath arrangement.

For producing the spun fibers, the distance between the means of interlacing and the means of drawing is in general less than the mean length of the fibers contained in the treated tow or band. In the present invention, the mean length of fibers in the tow, band or sliver can range from about 30 mm to about 200 mm, preferably from about 40 mm to about 80 mm.

The device for carrying out the process of the present application includes at least one drawing unit which can be, if desired, preceded by a stretching means used to thin down the stock sliver or band. The possibility of feeding-in a plurality of slivers of different colors and/or characteristics and/or fibers, make it possible to obtain special effects either on the finished yarn or by subsequent treatment, these treatments including, for example, heat treatments, treatments of dyeing of products having different dyeing affinity, treatments for placing the yarn under tension, which may or may not be accompanied by relaxation and/or heat treatment, etc.

The fluid medium employed in the interlacing means is generally air which can optionally contain liquids (water, steam, sizing agent, dyestuff, etc.). The interlacing fluid is fed in at a pressure which is preferably between 1 and 6 bars. The interlacing device is of the known conventional type, such as shown in U.S. Pat. No. 3,571,868, which allows interlacing to be achieved, not by false twise but by simple action on the fibers passing through the device. It is preferred to use single-jet nozzles of the open type, namely having a slit for introducing the yarn or the tow or band or other fiber gouping.

It is also possible to use a plurality of nozzles arranged in series and separated from one another, if desired, by rollers. Under these conditions the first nozzle is advantageously an open single-jet nozzle in which the pressure is set to the lowest possible value so as to avoid creating irregularities on the spun yarn being formed, for example at least about 2 bars, this nozzle being so located that the removal of the fluid, which for the greater part takes place via the slit through which the yarn is introduced, does not disturb the positioning of the fibers in the nozzle and between the feed roller and the orifice of the channel for the passage of the yarn in the nozzle. In the second nozzle, which can also be a single-jet nozzle, or can comprise several jets, for example 2, 3 or 4, and is preferably open, the pressure is greater than that of the fluid fed into the first nozzle. Of course, the pressures of the fluid in the first and the second nozzle depend on the speed of formation of the yarn, on the count of the desired spun yarn and of the denier of the individual strands of the fibers. It is possible, without going outside the scope of the present invention, to use closed nozzles, to the extent that they are designed for the fluid to escape without an adverse effect on the spun yarn being formed.

The temperature of the interlacing fluid is generally ambient temperature. However, if fibers having special characteristics are employed, such as shrinkable fibers, fibers with latent crimp, etc., higher temperatures can be used. In operation, the first nozzle must be so located that the angle $\alpha$ formed by the axis of the channel for the passage of the yarn in the nozzle and by the yarn is between 10° and 80°, preferably between 20° and 60°. This positioning prevents the escape of fluid along the channel for the passage of the yarn from interfering with the implementation of the process and from creating defects on the yarn.

The invention will now be described in greater detail by way of preferred embodiments and with the aid of the accompanying drawings in which.

Figure 1:
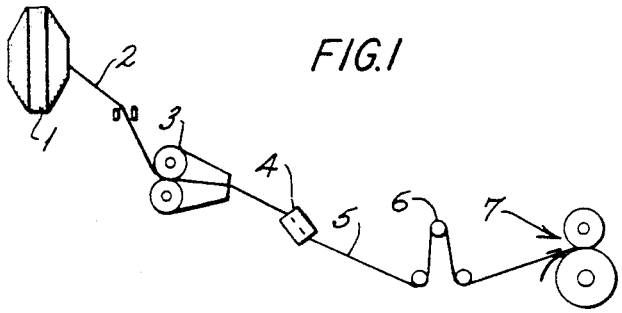
FIG. 1 is a flow diagram illustrating one embodiment of the process and apparatus of the invention.
Figure 2:
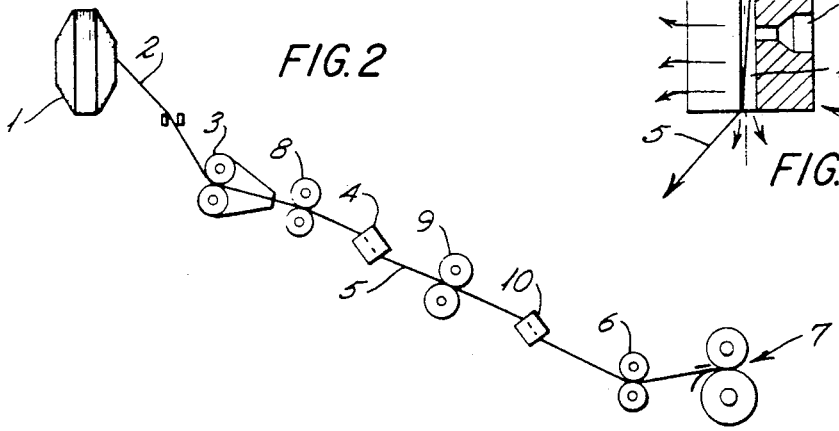
FIG. 2 is a flow diagram illustrating a modified embodiment of the process and apparatus of the invention.

FIGS. 1 and 2 diagrammatically show: means 1 for feeding the sliver or band 2, generally a bobbin or a pot, means 3 for drawing and, if required, stretching, means 4 for interlacing, the resulting spun yarn 5, means 6 or 6' for controlling the tension of the spun yarn 5, and means 7 for winding up the spun yarn 5. In FIG. 2, a pair of rollers 8 is interposed between means 3 for drawing and means 4 for interlacing, and moreover a second pair of rollers 9 and a second means 10 for interlacing, are interposed between the aforementioned means 4 of interlacing and means 6' for controlling the tension.

Figure 3:
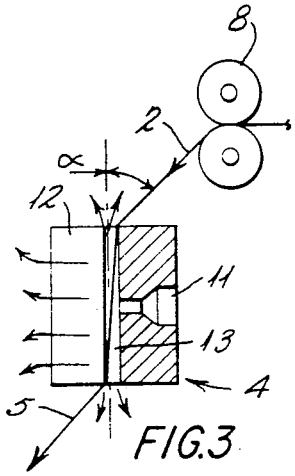
FIG. 3 is a schematic side elevation view of a single-jet interlacing nozzle used in the present invention.

FIG. 3 shows an example of the open single-jet means 4 for interlacing. In this figure there may be seen the sliver 2, and the spun yarn 5 which is obtained by passing the sliver through the channel 13 in which it is subjected to a jet of fluid, e.g., air, coming from the orifice 11. The means are shown in section along the axis of the channel for the passage of the yarn; 12 represents one of the lips of the slit for introduction of the yarn, this being the slit through which the greater part of the fluid, represented by the arrows, escapes.

In operation, the sliver 2, coming from the bobbin 1, passes through the drawing unit 3 and, on leaving the latter, and optionally rollers 8, passes at an angle $\alpha$ into the means of interlacing 4, from which issues the spun yarn 5, which then passes over the means for controlling the tension of the spun yarn 5, the latter being subsequently wound up on a bobbin by known means 7.

Figure 4:
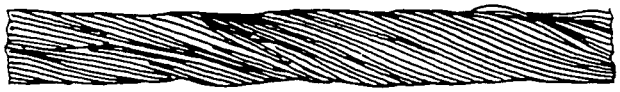
FIG.4 PRIOR ART
FIG. 4 is an enlarged photograph of a conventional spun fiber yarn obtained by a conventional twisting process.
Figure 5:
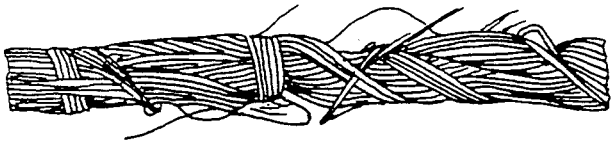
FIG.5 PRIOR ART
FIG. 5 is an enlarged photograph of a conventional spun fiber yarn obtained by a conventional fluid interlacing process in which the fibers are held in bundled segments.
Figure 6:
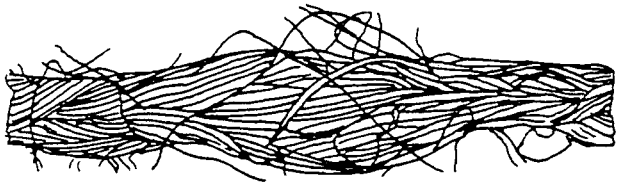
FIG. 6 is an enlarged photograph of a spun fiber yarn according to the present invention.

In FIG. 4, a spun fiber yarn obtained by a conventional twisting process is shown at a magnification of about 150X. In FIG. 5, a spun fiber yarn obtained by fluid means but with the fibers held in the manner of bundles is shown at a magnification of about 200X. FIG. 6 shows the spun fiber yarn according to the present application at a magnification of about 50X.

The spun like fiber yarns according to this invention exhibit textile characteristics similar to those of the spun fiber yarns obtained by prior art processes but are characterized by open or bulky zones having a non-twisted structure with parallel strands alternating with closed or dense zones in which the fibers are interlaced without bundling. They moreover exhibit, in the open, bulky zones, free strands which are more or less perpendicular to the axes of the spun yarns. The cohesion factor or "degree of interlacing" of the spun fiber yarn is in general greater than 100 and is preferably between 120 and 200, especially preferably between 120 and 180.

The lengths of the open, bulky zones and of the relatively dense, compact closed zones separating the open, bulky zones can be regulated by control of such parameters as the speed of passage of the fibers through the nozzle, the number of jets, the pressure of the interlacing fluid, the tension applied to the yarn, the distance between the interlacing nozzle and the drawing unit and the like. Generally, the ratio between the length of the open zones and the length of the closed zones will be about 1:1 but can vary from about 1:2 to about 1:30. For most typical spun yarns according to the invention produced at fluidization pressures of 1 to 6 bars and winding speeds of from about 50 to 200 meters per minute, the length of the open zones, i.e. the distance separating the end of one closed zone from the beginning of the next closed zone, will be from about 5 mm to about 30 mm, preferably from about 12 mm to about 25 mm.

The tensometric properties in respect of breaking strength and elongation at break are good and generally values for breaking strength of at least about 150 grams, especially at least about 400 grams, up to about 1000 grams or more, and values for elongation at break of about 8% to about 25% can be achieved. The yarn obtained by the process of the present application is very suitable—without additional twisting and without a heat-setting treatment (for example steaming)—for processing on a weaving loom or knitting machine or for any other downstream textile use.

The spun like yarns obtained can be used as such or in combination with other, conventional, spun yarns, or continuous filament yarns.

To measure "the degree of interlacing" or "coherency factor" of the yarns, the known so-called "hook" method as described, for example, in U.S. Pat. No. 3,727,274, is used. For this method, a load of 0.2 g/denier is suspended from a sample of yarn which is in a vertical position, and thereafter a thin hook supporting a weight is inserted into the bundle of fibers; the combination of hook and weight has a weight in grams numerically equal to the mean denier of the fibers, but care must always be taken to place a substantially equal number of fibers on either side of the hook. Thereafter, the hook is lowered at a speed of about 2 cm/min until the weight of the hook is supported by the yarn. The distance x in centimeters which the hook travels characterizes the degree of interlacing D which is calculated from the equation $D=(100/x)$. The measurement is repeated 100 times, using a fresh length of the same yarn for each measurement.

The examples which follow illustrate the present application without limiting it.

EXAMPLE 1

A cable of continuous filaments of poly(ethylene glycol terephthalate), of the low-pilling type, having a denier of 70 Ktex and a denier per strand of 1.6 dtex is converted to a 12 g/m sliver, and cut, at an angle of 35°, to 3½ inches. This sliver is subjected to 4 intersecting passages so as to hackle and parallelise the strands; after the 4th intersecting pass the sliver passes into a finisher of the sleeve drawing-box type. The treatment which the cable undergoes until it passes over the finisher conforms to the treatment normally carried out in conventional spinning. The finished sliver has a denier of 2.15 Nm. This sliver feeds a 3-cylinder double-sleeve type drawing unit regulated to give a draw of 14 so that the denier on leaving the unit is 30 Nm. At 40 mm distance from the exit of the drawing unit is located an interlacing nozzle such as that shown in FIG. 2, the diameter of the channel through which the yarn passes being 3 mm, and the nozzle being fed through a channel of 2 mm diameter. This single-jet nozzle has a lateral threading-up slit, the latter being so arranged that the jet of escaping fluid does not disturb the fibers at the exit from the drawing unit ($\alpha=45°$). In the design of the nozzle used, the actual distance between the jet of fluid and the exit from the drawing unit is about 50 mm. Downstream of the nozzle, a take-off roller makes it possible to accurately control the tension of the fibers in the interlacing zone. The spun like yarn obtained is wound up on a conventional reducer under a tension which gives a mean density of bobbin of the order to 0.5 to 0.7. The speed of the drawing unit is 60 m/min at the exit, the speed of the take-off roller is 0.8% less, and the pressures in the nozzle are, in the various embodiments, respectively 2, 3 or 4 bars. The tensile strengths of the yarn obtained vary essentially as a function of the pressure used, the breaking load being respectively 150, 321 and 246 g, with an elongation at break of 11, 12 and 11%. At pressures of 2, 3 and 4 bars, the cohesion factors of the yarn are respectively 106, 130 and 120, and the maximum distance between two points of cohesion is 20, 15 and 15 mm, respectively.

EXAMPLE 2

The spun yarn of Example 1 is processed under the same conditions as in the latter except that the speed of the drawing unit is regulated to 120 m/min at the exit, and the speed of the take-off roller is kept at 0.8% less than this. The pressures used are 2, 2.5 and 3 bars. The maximum tensile strength obtained with the spun yarn is in this case respectively 409, 428 and 435 g, depending on the pressures used, the elongation at break is 13%, 12.5% and 12%, the cohesion factors are respectively 142, 140 and 150 and the maximum distance between two points of cohesion is 15, 14 and 14 mm, respectively. The spun like yarns thus obtained are subjected to a pre-tension of 10 mg/dtex and are then relaxed; an increase in apparent volume in a ratio of 1 to 3 is found, by virtue of the structure of the spun yarn. In comparison, a spun yarn of the same count obtained by twisting on a conventional frame and handled uner the same conditions retains its original apparent volume.

The spun yarns thus obtained can be used directly in weaving or knitting, without steaming or auxiliary treatments usually carried out on conventional yarns.

EXAMPLE 3

A sliver, of 1.7 Nm, coming from a finisher, is treated. The sliver is composed of 60% of low-pilling poly(ethylene glycol terephthalate) fibers of 1.6 dtex per strand, staple length 3½ inches, and 40% of a two-component fiber (one component being poly(ethylene glycol terephthalate) and the other poly(butanediol terephthalate) crosslinked with trimethylolpropane), of 3.3 dtex per strand and staple length 3½ inches. The draw ratio of the drawing unit is 11. After interlacing, a 19 Nm spun yarn is obtained. The exit speed is 124.5 m/min. The pressure of the nozzle is kept at 2 bars. The speed of the take-off roller is regulated so as to differ by −2.4%, −1.2%, −0% and +0.8% from the exit speed of the drawing unit.

| | −2.4% | −1.2% | −0% | +0.8% |
|---|---|---|---|---|
| Breaking load, g | 696 | 648 | 582 | 500 |
| Elongation at break, % | 14 | 14 | 14 | 14 |
| Cohesion factor | 142 | 130 | 128 | 102 |
| Maximum distance between two knots, mm | 19 | 17 | 18 | 13 |

EXAMPLE 4

Using identical conditions to those of Example 3, with a speed of the take-off roller 1.2% lower than the exit speed of the drawing unit, and a pressure of 2 bars, the distance between the nozzle and the drawing unit exit roller is varied, the values being 30, 40 and 55 mm.

| | 30 mm | 40 mm | 55 mm |
|---|---|---|---|
| Elongation at break, % | 14.5 | 14 | 14 |
| Breaking Load, g | 648 | 648 | 692 |
| Cohesion factor | 132 | 142 | 134 |
| Maximum distance between two knots, mm | 18 | 17 | 15 |

It is found that if the distance is less than 15 mm or greater than 80 mm, running becomes difficult and the losses of fibers become substantial.

EXAMPLE 5

Under conditions identical to those of Example 3, a nozzle of the type defined in Example 1 and a second, so-called tri-jet drive nozzle are used, the latter having a diameter, of the spun yarn passage, of 3 mm and being fed by three convergent jets of 1 mm diameter, this second nozzle being placed 200 mm from the first. The first nozzle ($\alpha=45°$), the so-called cohesion nozzle, is fed at a pressure of 1.5 bars, while the second nozzle ($\alpha=10°$), the so-called compacting nozzle, is fed at 1.5, 2 or 2.5 bars.

The characteristics of the yarns obtained depend on the pressures and are as follows:

| | | | |
|---|---|---|---|
| Pressure, bars | 1.5 | 2 | 2.5 |
| Elongation at break, % | 14 | 13.5 | 14.5 |
| Breaking Load, g | 710 | 764 | 762 |
| Cohesion factor | 150 | 160 | 156 |
| Maximum distance between two points of cohesion, mm | 13 | 13 | 13 |

It is found that use of the second nozzle results in an increase in tensile strength of 15%, a more uniform appearance of the spun like yarn and a cohesion factor of 160 knots per meter, with a mean distance of 6 mm between knots and a maximum distance of 13 mm.

EXAMPLE 6

This example illustrates the production of spun like fiber yarn using the apparatus arranged as shown in FIG. 2. Starting with the same apparatus used in Examples 1 to 5 two superposed rollers (9) which can be adjusted, in respect of distance and speed, relative to the exit rollers (8) are added at the exit of the drawing unit. Between these respective sets of rollers is placed a cohesion nozzle ($\alpha=45°$) of a model identical to that used in Examples 1 to 5. The compacting nozzle ($\alpha=15°$) is placed between the pairs of rollers 9 and 6'. Under these conditions, the spun yarn obtained starting with the sliver of Example 3 has the following characteristics, compared to those of a spun yarn obtained on a conventional continuous spinning machine:

| | According to the present application | Continuous spinning machine |
|---|---|---|
| Nm fed in | 1.7 | 1.7 |
| Draw | 11 | 11 |
| Speed of spun yarn, m/min | 124 | 25 |
| Nm of spun yarn | 18 | 18.5 |
| Elongation, % | 17.5 | 21.2 |
| Breaking load, g | 810 | 1,010 |
| Cohesion factor | 160 | |

The spun like yarn thus obtained can be used, without steam treatment or post-twisting, in weaving or knitting.

In the weft, the covering power of such a yarn is considered to be 20% greater than that achieved by using a conventional spun yarn.

From the foregoing examples it can be readily appreciated that spun fiber yarns having greater bulk and correspondingly increased covering power than conventional spun fiber yarns are provided by the open zones whereas fiber coherency and structural strength comparable to or superior to conventional spun fiber yarns are provided by the "knots" in the intertwined compacted closed zones.

Moreover, the spun like fiber yarns of this invention can be produced at substantially greater speeds than conventional spun fiber yarns having the same count and denier.

What we claim is:

1. A spun like fiber yarn produced from at least one group of fibers, the fibers in each group of fibers being of the same length, said yarn having alternating zones of loosely packed open fibers and closely packed fibers, the fibers in the open zones being arranged in parallel and being non-twisted, the open zones further including free strands, the fibers in the closely packed zones being interlaced and non-bonded, and the spun fiber yarn having a cohesion factor of more than 100.

2. The spun like fiber yarn of claim 1 which has a cohesion factor in the range of from about 120 to about 180.

3. The spun like fiber yarn of claim 1 which is comprised of synthetic fibers.

4. The spun like fiber yarn of claim 1 wherein the ratio of the length of the open zones to the length of the closely packed zones is in the range of from about 1:1 to about 1:30.

5. The spun like fiber yarn of claim 4 wherein the length of the open zones is from about 10 millimeters to about 30 millimeters.

6. The spun like fiber yarn of claim 4 wherein the length of the open zones is from about 12 millimeters to about 25 millimeters.

7. A process for producing a spun like fiber yarn having alternating open zones and closed zones with the fibers in the open zones being non-twisted and parallel and the fibers in the closed zones being interlaced and non-bonded, said process comprising feeding at least one group of staple fibers in which all of the fibers in each group are of the same length to a drawing unit, passing the drawn fibers through the open channel of a first open single-jet interlacing nozzle at an angle to the axis of said channel, wherein said channel is being fed with an interlacing fluid at a pressure ranging from about 1 bar to about 6 bars and wherein the angle formed by the axis of the channel and the drawn fibers is in the range of 10° to 80°, and winding up the resulting spun yarn at a speed greater than 50 meters per minute.

8. The process of claim 7 wherein the angle between the axis of the channel and the drawn fibers is from 20° to 60°.

9. The process of claim 7 wherein the staple fibers have a mean length in the range of from about 20 millimeters to about 200 millimeters.

10. The process of claim 7 wherein the interlacing fluid comprises air.

11. The process of claim 10 wherein the interlacing fluid is fed substantially perpendicularly into said open channel of said single jet interlacing nozzle.

12. The process of claim 7 wherein the distance from the exit of the drawing unit to the entrance to the interlacing nozzle is less than the length of the staple fibers.

13. The process of claim 7 wherein prior to being wound-up, the fibers are passed through at least one additional open interlacing nozzle located downstream of said first interlacing nozzle, said second open interlacing nozzle having at least one jet feeding interlacing fluid to the open channel thereof, wherein the pressure of the interlacing fluid in the first interlacing nozzle is lower than the pressure of the interlacing fluid in each additional interlacing nozzle.

14. The process of claim 13 wherein the angle between the axis of the channel for passage of the spun fiber yarn in each additional open interlacing nozzle and the spun fiber yarn passing therethrough is from 10° to 60°.

15. Apparatus for producing spun like fiber yarn having alternating open bulky zones and closed compact zones comprising at least one drawing unit;

means for feeding a group of staple fibers to the at least one drawing unit;

at least one open channel single jet fluid-utilizing interlacing device for interlacing the staple fibers, which have been drawn through the at least one drawing unit; wherein the open channel is disposed at an angle, relative to the path of travel of the drawn fibers of from 10° to 80°;

means for regulating the tension of the spun fiber yarn in the at least one interlacing device, and means of winding up the spun like fiber yarn.

16. Apparatus according to claim 15 which comprises a first open channel single jet fluid-utilizing interlacing device and at least one additional open channel fluid-utilizing interlacing device, each of said additional open channel interlacing devices including at least one jet nozzle for introducing the interlacing fluid to the open channel thereof and each of said additional interlacing devices being located downstream of said first single jet interlacing device, each of said interlacing devices being separated by a pair of rollers.

17. Apparatus according to claim 16 which has a single additional open channel interlacing device, said additional interlacing device having a single jet, said tension regulating means being located between said additional interlacing device and said winding up means.

* * * * *